US007856170B2

(12) United States Patent
Rusche et al.

(10) Patent No.: US 7,856,170 B2
(45) Date of Patent: Dec. 21, 2010

(54) DEVICE FOR PRODUCING STEAM AND COOKING APPLIANCE

(75) Inventors: Stefan Rusche, Lamerdingen (DE); Thomas Schreiner, Hurlach (DE); Thomas Garner, Landsberg/Lech (DE); Manfred Bucher, Landsberg/Lech (DE); Paul Linseisen, Ingolstadt (DE); Bruno Maas, Wertach (DE); Peter Kohlstrung, Kaufering (DE)

(73) Assignee: Rational AG, Landsberg/Lech (DE)

( * ) Notice: Subject to any disclaimer, the term of this patent is extended or adjusted under 35 U.S.C. 154(b) by 729 days.

(21) Appl. No.: 11/908,884

(22) PCT Filed: Feb. 21, 2006

(86) PCT No.: PCT/DE2006/000313

§ 371 (c)(1),
(2), (4) Date: Oct. 22, 2007

(87) PCT Pub. No.: WO2006/097062

PCT Pub. Date: Sep. 21, 2006

(65) Prior Publication Data

US 2008/0193110 A1 Aug. 14, 2008

(30) Foreign Application Priority Data

Mar. 15, 2005 (DE) ..... 10 2005 012 219

(51) Int. Cl.
*H05B 3/60* (2006.01)
*A47J 31/44* (2006.01)

(52) U.S. Cl. ..... 392/337; 99/288

(58) Field of Classification Search ..... 392/337, 392/338, 446
See application file for complete search history.

(56) References Cited

U.S. PATENT DOCUMENTS

| | | | | |
|---|---|---|---|---|
| 3,301,481 | A * | 1/1967 | Jonathan et al. | 236/46 R |
| 3,690,302 | A | 9/1972 | Rennolds | |
| 4,972,804 | A | 11/1990 | Stolmar | |
| 5,592,647 | A * | 1/1997 | Yamauchi et al. | 392/432 |
| 6,243,535 | B1 | 6/2001 | Bochud | |
| 6,959,668 | B2 | 11/2005 | Schreiner et al. | |
| 2009/0103907 | A1 * | 4/2009 | Nave | 392/463 |

FOREIGN PATENT DOCUMENTS

DE 904 653 4/1954

(Continued)

OTHER PUBLICATIONS

International Preliminary Report on Patentability for International Application No. PCT/DE2006/000313 including annexes, dated Jun. 26, 2007 (37 pages).

(Continued)

*Primary Examiner*—Daniel Robinson
(74) *Attorney, Agent, or Firm*—Marshall, Gerstein & Borun LLP

(57) ABSTRACT

A heatable housing and a device such as a cooking appliance including a heatable housing for producing steam includes at least one wall that delimits an interior space, which is enclosed by the housing at least in areas and which serves to hold a liquid to be vaporized. The wall has at least one hollow for accommodating at least one heating device.

25 Claims, 8 Drawing Sheets

FOREIGN PATENT DOCUMENTS

| | | |
|---|---|---|
| DE | 2 214 566 | 10/1972 |
| DE | 27 57 913 | 6/1979 |
| DE | 37 83 361 | 7/1993 |
| DE | 690 13 906 | 6/1995 |
| DE | 692 07 830 | 9/1996 |
| DE | 298 14 690 | 12/1998 |
| EP | 0 284 675 | 12/1992 |
| EP | 0 523 489 | 1/1996 |
| WO | WO-96/41099 | 12/1996 |
| WO | WO-98/36215 | 8/1998 |
| WO | WO-98/45647 | 10/1998 |
| WO | WO-00/11412 | 3/2000 |
| WO | WO-02/12790 | 2/2002 |

OTHER PUBLICATIONS

International Search Report for International Application No. PCT/DE2006/000313, dated Oct. 25, 2006 (5 pages).

Written Opinion for International Application No. PCT/DE2006/000313, dated Oct. 25, 2006 (6 pages).

* cited by examiner

E -E

DEVICE FOR PRODUCING STEAM AND COOKING APPLIANCE

BACKGROUND

1. Field of the Invention

The invention concerns a device for producing steam as well as a cooking appliance with such a device.

2. Related Technology

Conventional steam generators, as they are used especially in cooking appliances, usually have a boiler, which is tilled partially with water and which is brought to boiling with a heating element. The space requirement of such a steam generator is determined mainly by two factors, namely on the one hand by the fraction of volume that is filled with liquid water and, on the other hand, by the fraction of volume of the gas space located above the water.

In this case the first volume fraction is delimited by the size of the heating element and by the space needed between the heating elements for circulation around them and for removal of steam bubbles. In turn, the size of the heating element is determined by the Leidenfrost effect for a given heat output power, according to which, upon heating of a vaporizable liquid, a certain surface power density of a heating body cannot be exceeded, since otherwise a closed steam layer develops between the surface of the heating element and the liquid that prevents heat transfer. The Leidenfrost effect is demonstrated nicely by the phenomenon that the water droplets do not immediately evaporate on a glowing plate, but move almost in a dancing manner, since they move irregularly on the plate supported by a developing steam layer.

The second volume fraction is needed in order to separate steam from the entrained water droplets. The size and the shape of the second volume fraction, that is, of the gas space above the liquid, are decisive for the steam quality. The steam quality is determined especially by the size of the water surface over which the flow of steam must be passed. The larger the steam flow per water surface, the more water will be entrained by the exiting steam.

Overall, based on the above considerations, in conventional steam generators a larger space is required when a high steam quality is to be generated. However, it should be pointed out additionally that the time needed to make a water-filled steam generator ready for operation also depends on the amount of water introduced that is necessary to cover the heating element safely, which again establishes requirements with regard to the size of the steam generator.

In the area of power generators, especially nuclear power generators, steam generators are known in which a rotational flow is induced in a steam-producing fluid by injection of another fluid. The centrifugal forces that are involved in the rotational flow are used for the separation of contaminants, as described in U.S. Pat. No. 4,972,804 and DE 690 13 906 T2.

Furthermore, steam generators are known in which the entire tubular or barrel-shaped steam generator container is set into rotation, which is associated with high energy expenditure and cost, and, moreover, requires high constructional complexity, which makes necessary to have a rotating support for the heat generator container, as a result of which necessarily the introduction and discharge of fluid can only be practicable through the axle. For example, such a rotating steam generator is described in DT 2 214 566, designed for the evaporation of organic drive fluids in a closed circuit of a Rankine engine. The steam generator known from DE Patent 904 653 operates similarly, but in addition has a control for the fluid feed in order to adjust a fluid ring of specific thickness.

A rotating steam generator with a rotatably supported boiler is disclosed in DE 27 57 913 A1, which in its construction does not have rotatable feeds for the introduction or discharge of a fluid working medium.

A tandem separator for a steam-water mixture is known from DE 37 83 361 T2 around which baffles are arranged in a screw shape, which set the steam-water mixture into rotation.

DE 692 07 830 T2 discloses a steam generator arrangement for ovens, in which thin water jets or small water droplets set into rotation fall onto a heating device in order to be converted to steam.

However, the previously-described steam generators, especially in a cooking appliance, do not operate satisfactorily for the evaporation of tap water, but they have the severe disadvantage that the minerals dissolved in the tap water, especially lime, are deposited onto the walls and built-in parts of the steam generator. This can lead to the failure of or damage to the steam generator, which can be prevented, as a rule, only by regular chemical removal of the lime. The necessary maintenance work after usage caused thereby is, again, cost-intensive.

In order to overcome this disadvantage, in WO 02/12790 A1, a method is described for producing steam, especially for a cooking appliance, in which a liquid is brought to boiling within a steam generator container by heating of at least one heatable wall surface of the heat generator container, and is brought into rotation during heating by at least one rotatably supported first rotor in the steam generator container, as well as being pressed against the heatable wall surface by the centrifugal forces due to the rotation, and the steam produced by evaporation of at least a part of the escapes from the steam generator container through a steam outlet while droplets of the liquid entrained by the steam are being separated. Furthermore, WO 02/12790 A1 discloses a device for producing steam, especially for a cooking appliance, comprising a steam generator container, which can be filled at least partly with a liquid through an inlet and from which steam can arrive to a steam outlet, and a heating device for heating the fluid in the steam generator container for the purpose of producing steam, which exhibits a heatable housing, whereby the device has a first rotor in the steam generator container through which at least the liquid can be set into rotation. Through this method or through the device in WO 02/12790 A1, especially small steam generators are supposedly provided for producing steam of high quality which, in addition, can be made ready for operation quickly, are cost-effective, flexibly heatable and reliable, without tending to superheating and without requiring regular lime removal.

The method described in WO 02/12790 A1 as well as the device described in this document have been found to be fundamentally useful, since especially the laborious and cost-intensive maintenance work for removal of the lime in the steam generator becomes superfluous, as well as providing maximum heat transfer from the walls to the liquid during operation and not reduced by lime deposits, with the inner rotating components acting so to speak as a scraping device, with which the deposits on the walls are removed instantaneously during the operation, that is, during the rotation.

However, the device for producing steam described in WO 02/12790 A1, cannot remain under a certain construction size due to the use of thick-layer heaters as heating elements for the heating of the liquid in the steam generator container, and due to a limited heat transfer to the steam generator container.

Finally, WO 96/41099 A1 and WO 98/45647 A1 each disclose a generic device for producing steam in the form of a steam generator. The steam generators disclosed in these two documents have a metal block with a central bore for holding a liquid and a multiple number of heating element bores surrounding the central bore. In order to heat the liquid in the central bore, heating elements are introduced into the heating element bores. However, a disadvantage of these steam generators is that efficient heat transfer from the heating elements to the liquid located in the central bore is not ensured. Therefore, the heat input into the liquid is unsatisfactory.

GENERAL DESCRIPTION OF THE INVENTION

Therefore, it is the task of the invention to further develop the generic device for producing steam so that the disadvantages of the prior art are overcome, especially so that an increased heat transfer into a liquid arranged in the device is achieved, as a result of which the construction size of the device for producing steam can be reduced further, so that use in a cooking appliance is made possible.

Thus, the invention is based on the surprising finding that, by the integration of a heating device in a wall of a housing, the heat output power density given off by the housing can be increased. Especially by producing blind bores within a wall of the housing into which the heating devices can be inserted in the form of heating cartridges or straight electrical resistance heaters, the heat transfer can be increased significantly. Based on the output power that is provided by such heating cartridges or heating elements, the necessary number of heating devices for reaching a preset heat output power can be reduced, as a result of which a more compact construction of the device for producing the steam is made possible.

Moreover, with the invention, in an especially advantageous embodiment, the following way is proposed with which the heat output power made available by the heating device can be increased further. For this purpose, the heating device is not designed in the form of a heating cartridge which comprises a heating wire that is surrounded by a casing inserted into the hollow, but in the form of a heating wire that is inserted directly into the hollow, whereby the remaining space within the hollow is insulated preferably with a corresponding electrically-insulating (filling) material. This increase of the possible heat output power is to be attributed to the fact that with the use of heat cartridges an air gap can be present in the housing wall between the casing and the hollow, through which the output power made available by the heating cartridge is limited in order to avoid local overheating. For further reduction of possible air gaps between the casing and the hollow within the housing wall, the heating device according to the invention is designed to be longer overall than the hollow so that after insertion into the hollow it can be pressed against the hollow by the application of an axial pressure.

In addition, a hollow for a heating device or heating cartridge can open outward through another recess in the housing. According to the invention, this additional recess enables not only a simpler insertion of the heating device or heating cartridge into the housing but also an improved fit in the housing, namely by an at least partial pressing together of the said hollow, after the heating device or heating cartridge has been inserted, as a result of which again the danger of air gaps between the heating device or heating cartridge and the housing is avoided, which results in better thermal conduction.

Also, in an especially advantageous form of the invention, the housing according to the invention and the device according to the invention can be integrated into a rotary steam generator, especially a steam generator that operates according to the method in which a liquid is brought to boiling within a steam generator container by the heating of at least one heatable wall surface of it, upon heating at least one first rotor supported rotatably in the steam generator container is set into rotation, as well as pressed against the heatable wall surface by the centrifugal forces produced by the rotation, and in which the steam produced by the evaporation of at least a part of the liquid leaves the steam generator container through a steam discharge, and droplets of the liquid, which are entrained by the steam, are being separated.

Furthermore, it is proposed with the method that the centrifugal forces of the liquid and/or of the steam are greater than the gravitational forces on the liquid and/or on the steam.

Furthermore, it can be provided in the method that in the area of separation of the droplets of the liquid, the liquid and the steam are forced at least partly against at least one orifice, potential eddies are produced in the liquid and/or in the steam at least partially and/or no heating of the heatable wall of the container occurs.

It is also proposed that contaminants in the liquid are eliminated by forcing the liquid against at least one orifice.

It is also preferred in the method that the liquid is fed into the container with a minimum velocity, preferably directed onto the heatable wall surface and/or the first rotor.

Alternatively, it is proposed that the state of filling of the container is determined by measuring a centrifugal-force-induced pressure on at least one wall surface of the container, preferably from outside the container.

In addition, at least one pressure sensor for the detection of the pressure existing in the liquid, especially in the area of a wall of the steam generator container is provided, whereby it has then been found to be especially advantageous to adjust the heat output power of at least one heating device or heating cartridge as a function of the values measured by the pressure sensor, preferably for the setting of a constant pressure along the wall of the steam generator container, especially to avoid the development of deposits, such as in the form of a lime layer along the wall.

Furthermore, at least one temperature sensor and/or thermal switch can be provided, especially in thermal contact with the wall, whereby preferably, deposits such as a lime layer on the wall, especially on the surface of the wall facing the interior chamber, can be detected based on the output data of the temperature sensor, especially based on its time course. This makes it possible to interrupt the operation of the heating device(s) as a function of the detection of deposits.

Moreover, it was found that it is especially favorable to keep the material necessary for the steam generator container as small as possible in order to promote temperature-dependent expansions and contractions to produce rapid flaking off of any lime layers that might possibly be formed. For this purpose, the housing can be provided with hollows, especially between the areas where the heating devices are positioned.

Another embodiment of the method is characterized by the fact that in the steam that leaves the steam generator container the condensed and/or evaporated liquid is set into rotation by a second rotor in at least one additional liquid separation container connected after the steam generator container, and the condensate is separated and also removed from the liquid separation container and preferably recycled to the steam generator container.

Hereby it can be provided that the first rotor in the steam generator container and the second rotor in the liquid separator container are set in rotation with a motor, preferably using the same rotary axle.

Furthermore, it can be provided in the method that the steam is directed to the steam discharge at least partly through a tube arranged in the steam generator container, preferably in the form of a hollow shaft, which is connected to the rotor(s).

Furthermore, preferentially, it is provided in the method that the first and/or the second rotor, at least during its/their rotation, are in sliding contact at least in areas with the wall surface or with the deposits on the wall surface of the steam generator container or liquid separation container and that it/they loosen the deposits, especially in the form of lime deposits, away from the surface.

Hereby, it can be provided in the method that the distance between the first and/or second rotor and of the corresponding wall surface are dimensioned so small that a deposit formed, especially a lime deposit, is removed by the rotation of the first or second rotor.

It is also proposed that the first and/or second rotor have no contact with the corresponding wall surface in the resting position, and that, due to centrifugal forces, upon rotation will be pressed in the direction of the corresponding wall surface at least in areas.

In addition, it is proposed that the wall surface and/or the rotor are heated until they are dry with the rotor rotating and/or resting after an operating phase and/or wetting with liquid, whereby adhesion of the rotor to the wall surface due to the deposits will be avoided.

Furthermore, it is also proposed for the method that the steam generator container is emptied when the first rotor is resting, preferably automatically, especially through a steam-tight waste-water discharge.

In the method described above it can also be provided that the inlet is made of a flexible material and is deformed by the pressure of the entering liquid, in order to remove deposits in the inlet, at least partially.

Among other things, it is also proposed that the inlet is cooled with a liquid stream which is maintained continuously with the aid of a control and/or regulating device, whereby the liquid will be taken from a reservoir and/or a feed line and deposits will be prevented, at least in areas.

It is also proposed with the invention that, in the device for producing steam, the container has two opposite-lying ends, whereby the inlet and the steam outlet are arranged either both on one end or each on another end.

However, it is also especially advantageous when the steam discharge and a liquid discharge are arranged on one end, namely preferably on a lower end, so that emptying of the container is possible under the action of the gravitational force, while an inlet is arranged either in the area of the container or on the other, upper, end of the container.

Here, the first rotor which then is also preferably the only rotor, may comprise a paddle whose shaft is separably connectable with the shaft of a motor, whereby the motor again can be provided in a cover of the housing for closing the upper end. This upper cover can, for example, also be screwed directly onto the housing, whereby for this purpose screw channels can already be provided in the housing. The paddle can be designed to be so lightweight that it can be no longer supported at the lower end of the housing, such that one can completely eliminate a bearing within the area in which steam, water/liquid and/or lime can be located, which increases the life of the steam generator container overall.

The separation of steam and water downstream from the lower end of the housing can be carried out through a simple siphon in the embodiment described last. Above this siphon again a branch can be introduced with a riser through which the steam can be removed and introduced to a cooking compartment of a cooking appliance. Entrainment of water in the steam can be provided through corresponding dimensioning of the riser and possibly additionally through appropriate design of this tube.

The opening of the housing at the lower end must first of all be large enough so that the steam generator container can be emptied rapidly in order to avoid long waiting times before restarting the operation. On the other hand, the diameter must be small enough so that liquid can be prevented from flowing down only by the rotation of the first rotor, especially the paddle.

A device according to the invention can thus be characterized by an opening for preferably automatic discharge of the liquid when the rotor is stopped and/or a third orifice in the area of the steam generator container with a lowest gravitational potential, whereby the opening during the rotation is closed with the aid of a closure mechanism, for example one comprising a siphon.

Further, it is proposed that the steam generator container has a rotational symmetry with respect to an axis, preferably is essentially tubular or is conically widening from the inlet to the steam discharge.

Hereby a device can also be characterized by the fact that the axis of the steam generator container coincides with the rotational axis of the first rotor, whereby preferably the rotational axis runs essentially parallel to the direction of the gravitational force.

A device is also preferred which is characterized by at least one orifice for the separation of droplets of liquid entrained by the stream and/or contaminants in the liquid entrained with the steam.

Hereby it is also proposed that a first orifice downstream of the inlet and/or a second orifice upstream from the discharge are arranged.

In addition, it is proposed that the first rotor is drivable by a motor via a shaft, whereby the shaft is especially a hollow shaft with radial bores and/or slits arranged along the longitudinal side of the hollow shaft in order to make steam transfer from the steam generator container to the steam discharge possible.

Furthermore, a device can be characterized by a liquid separation container between the steam generator container and the steam discharge, whereby preferably a liquid return to the steam generator container runs from the liquid separation container.

Hereby it can be provided that a second rotor can be rotated in the liquid separation container, which is coupled to the first rotor, preferably mechanically.

In the device it can also be provided that the first and/or second rotor comprise a removal device which removes deposits during rotation, at least in areas, from a wall surface of the steam generator container or liquid separation container.

Hereby it can be provided that the removal device comprises brushes, lamellae, fringes and/or lips, preferably consisting of heat-resistant material that is appropriate for coming into contact with foods.

Furthermore it is proposed that the removal device has at least in areas a thicker material on the side lying closest to the wall surface during rotation.

Preferably it is proposed for the device that the removal device has no contact with the wall surface in the resting state, however, during rotation it should have, preferably by the use of at least one spring device.

In the device, it can also be provided that the first and/or second rotor are designed in the form of a paddle, preferably with two paddle halves, in a spiral form, screw form and/or stellate form.

Finally, it is proposed that the rotor itself is flexible, preferably in the form of brushes, lamellae, fringes and/or lips and has no contact with the wall in the resting state.

Due to the fact that in the method or device described above steps are taken to rotate the built-in parts instead of the steam generation container, especially the following advantages are achieved:

i) reduction of the moment of inertia, as a result of which at the same time the energy requirements are reduced, response times are reduced, control times are reduced, bearing forces are reduced and balancing problems are reduced; and ii) the structure is simplified, for example by simplification of the installation and contacting of a heating device, as well as by avoiding constructively expensive structural shapes as they are customary in the case of rotating external containers, in order to avoid, among other things, lines that have to be designed rotatably.

In addition, if one chooses the alternative in which the steam discharge and the liquid discharge are arranged at a lower end of the steam generation container, a specifically compact construction is obtained, which especially makes it possible to connect the steam generator near its center of gravity to a basic cooking appliance structure at a single point in a vibration minimizing manner by means of a screw connection housed in rubber.

BRIEF DESCRIPTION OF THE DRAWINGS

Other characteristics and advantages of the invention follow from the description below, in which practical examples of the housing and of the device according to the invention are explained in detail with the aid of schematic drawings. The following are shown.

DETAILED DESCRIPTION

Figure 1:
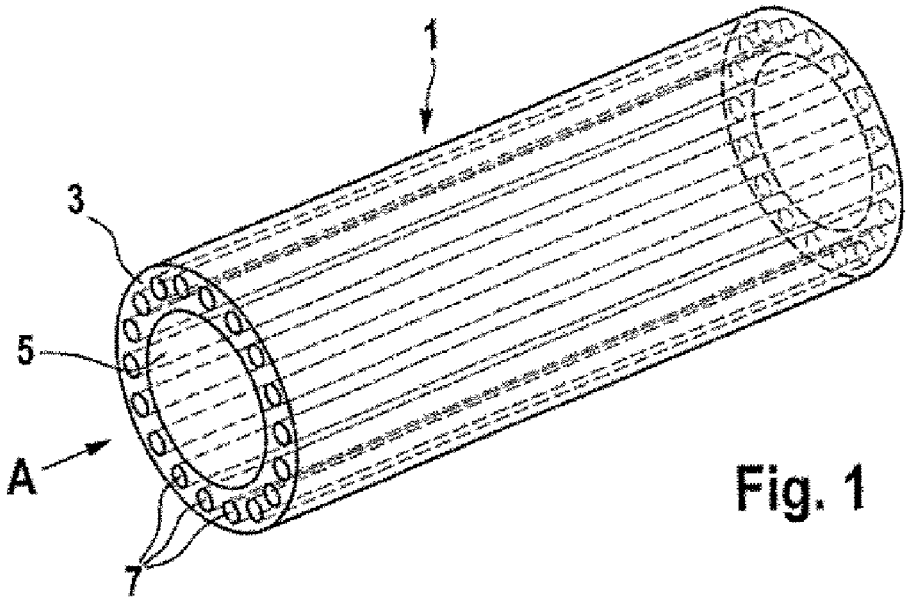
FIG. 1 is a perspective, schematic view of a first embodiment of a heatable housing.

FIG. 1 shows a schematic view of a heatable housing 1. Housing 1 is designed essentially to have a tubular shape, and has a wall 3. Wall 3 surrounds an interior chamber 5. A number of hollows in the form of bores 7 are formed within wall 3. As can be seen especially in FIG. 1, bores 7 penetrate the wall 3 of housing 1 completely, along the entire longitudinal axis of housing 1. Hereby bores 7 run essentially parallel to the surface of wall 3 facing interior chamber 5.

Figure 2:
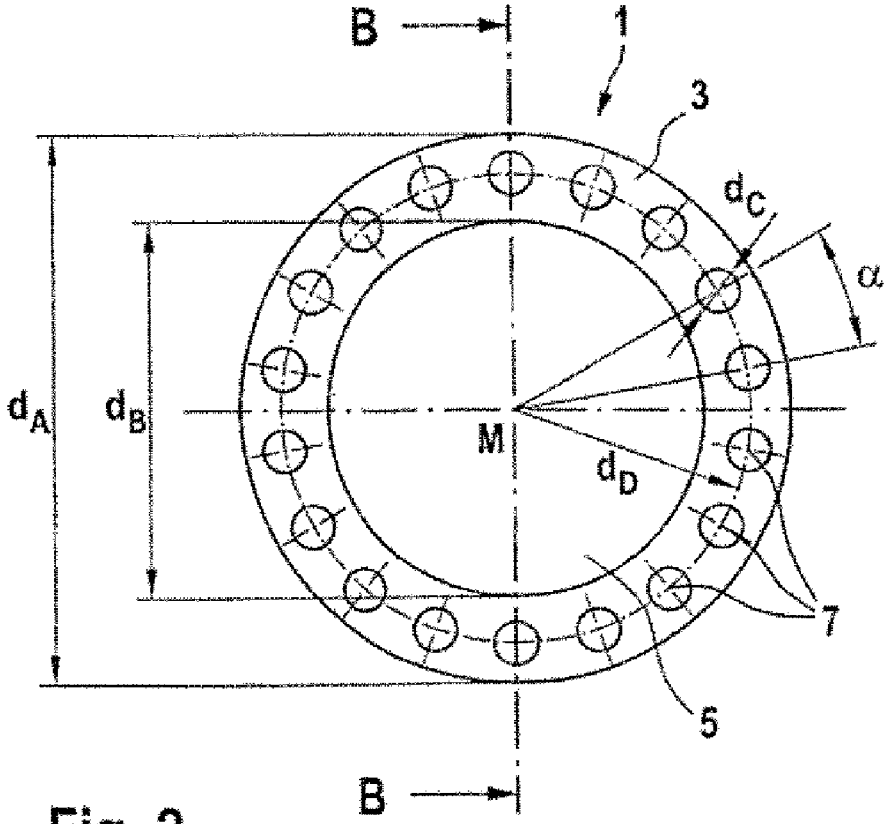
FIG. 2 is a side view onto the housing of FIG. 1 from direction A.

As can be seen especially in FIG. 2, which represents a side view of housing 1 from direction A in FIG. 1, bores 7 are distributed regularly around the periphery of wall 3. Especially, housing 1 has 18 bores 7, that is, the angular distance $\alpha$ between the individual bores 7 is approximately 20° . When using housing 1 as a boiler within a steam generator, the housing 1 can have, for example, the following dimensions. The outside diameter $d_A$ of the essentially tubular wall 3 is, for example, 88 mm, while the inside diameter $d_B$ of wall 3 is approximately 60 mm. Furthermore, the bores 7 can have a diameter of approximately 6.5 mm and can be arranged at a distance of approximately 37 mm from the midpoint M.

Figure 3:
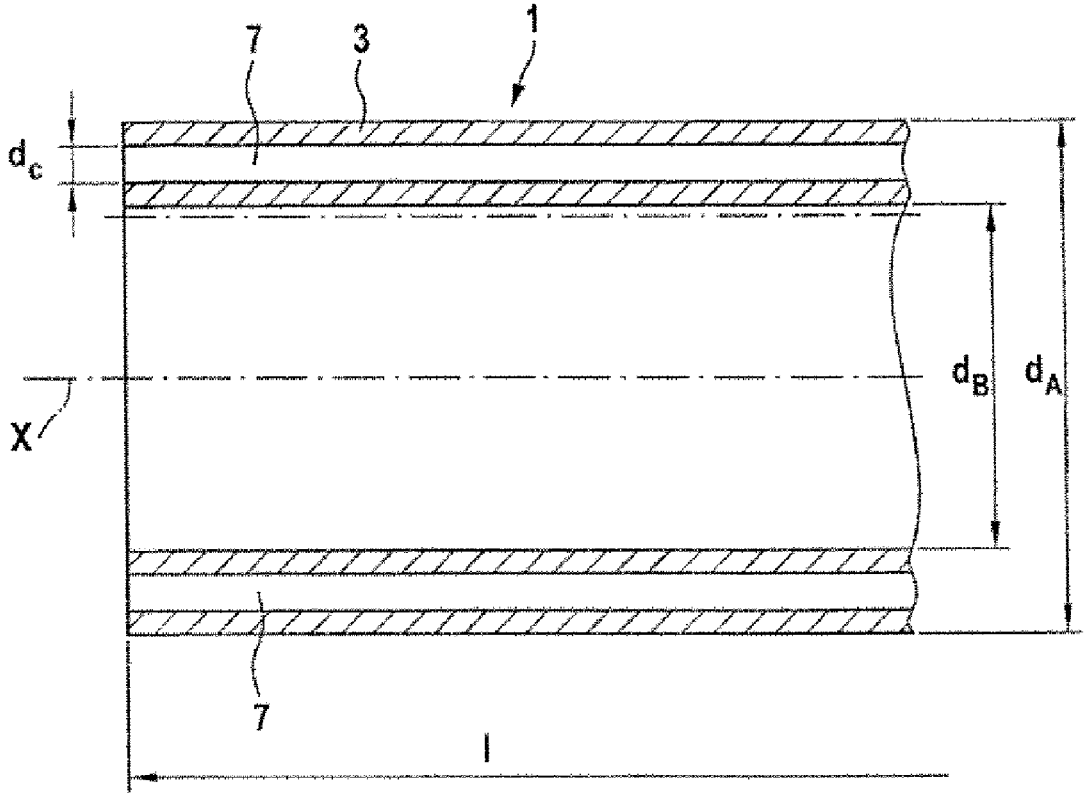
FIG. 3 is a schematic partial sectional view of the housing of FIG. 2 along line B.

As can be seen especially from FIG. 3, which shows a sectional view of housing 1 from direction B in FIG. 2, the length of the housing 1 is, for example, 250 mm.

Regarding the stating of these dimensions, it is emphasized that these are only examples, and naturally other dimensions can be chosen.

Figure 4:
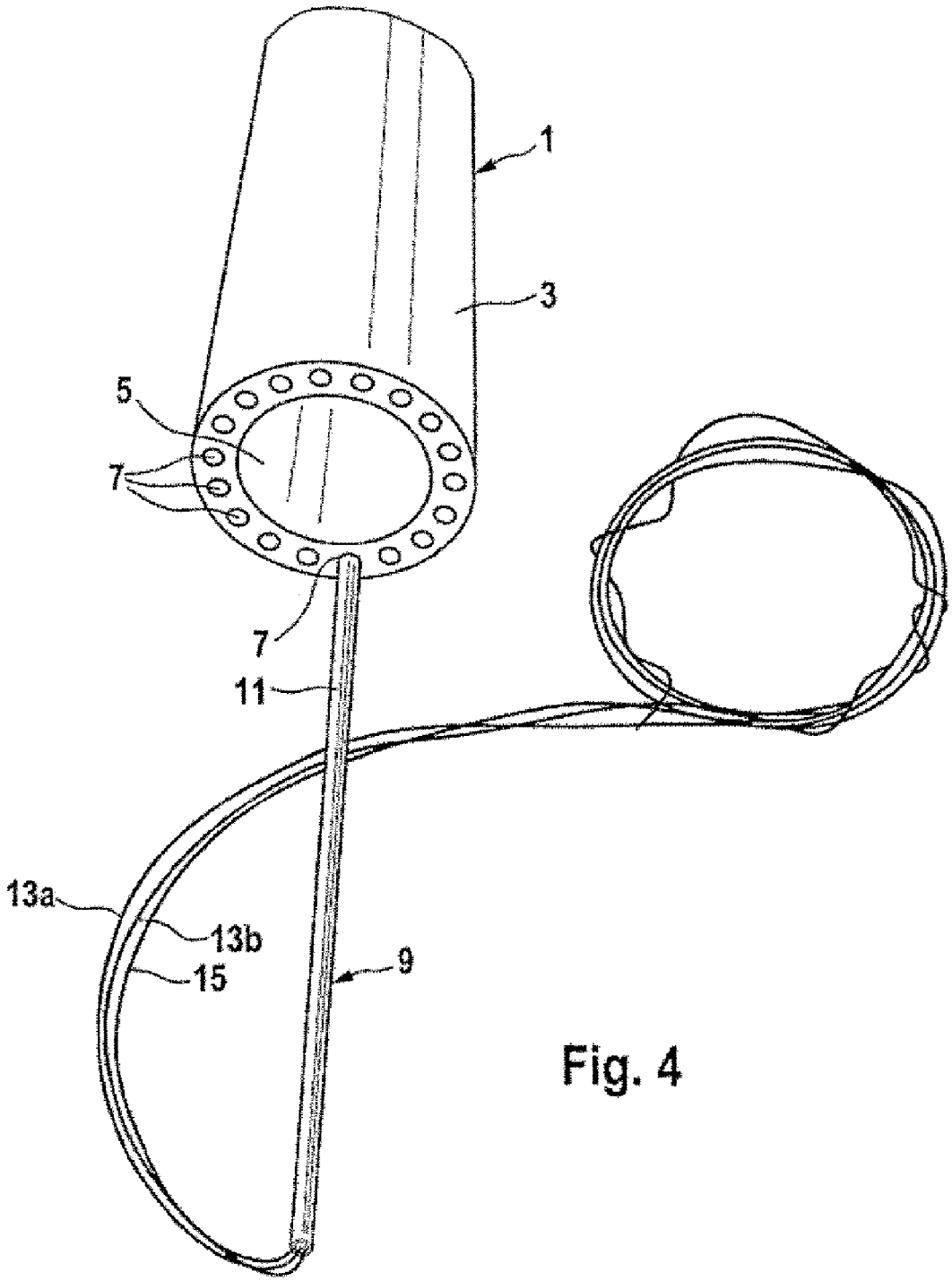
FIG. 4 is a depiction of the first embodiment of a housing with a heating cartridge.

FIG. 4 is a top view onto housing 1. As can be seen in FIG. 4, a heating device in the form of a heating cartridge 9 is inserted partially into one of the bores 7. The heating cartridge 9 comprises a first cladding tube in the form of a casing 11. Preferably this casing 11 is made of a stainless steel material. Furthermore, the heating cartridge 9 within casing 11 comprises a heating wire, which is not shown, and which can be supplied with electrical energy to produce heating output power via lines 13*a*, 13*b*. Furthermore, the heating cartridge 9 comprises a signal line 15, which is connected with a temperature sensor, not shown, which is surrounded by heating cartridge 9. With the aid of this temperature sensor, the local temperature of the heating cartridge 9 and of wall 3 can be measured in the area of bore 7 where the heating cartridge 9 is located. Using the course of the temperature thus determined, especially in the case when housing 1 is used as a boiler of a steam generator, it can be determined if a perturbing lime layer has formed on the surface of wall 3 that faces the interior chamber 5. For this purpose the signal line 15 is connected to a regulating and/or control device which is not shown, whereby preferably with the aid of the control and/or regulating device, the operation of the (rotating) steam generator is adjusted when a corresponding lime layer is detected.

In order to achieve good heat transfer between the heating cartridge 9 and wall 3 in the area of bore 7, the outside diameter of the casing 11 corresponds essentially to the inside diameter of bore 7. The very small tolerances necessary for this can be achieved based on the fact that the casing 11 is made of a stainless steel material which makes it possible to regrind the casing 11 in order to adjust the outside diameter of the casing 11 to the inside diameter of bore 7. In order to achieve good heat transfer of the heat produced by the heating cartridge 9 through wall 3, it is preferable to make the wall 3 of aluminum at least in areas. Furthermore, it is provided that the heating cartridge 9 within casing 11 is filled, in addition to the heating wire which is not shown, with an essentially electrically insulating but thermally conducting filling material. Hereby it is preferred that the casing 11 is filled with magnesium oxide as filling material.

However, the use of the heating cartridge 9 shown in FIG. 4, which comprises a casing 11 made of stainless steel material leads to increased production expense. Thus, the use of a stainless steel material as casing 11 is expensive and the adjustment of the outside diameter of the casing 11 to the diameter of bore 7 leads to an expensive production process, since the outside diameter of casing 11 must be manufactured with very small tolerances. Furthermore, it may be necessary to regrind the casing 11 manually in order to achieve the corresponding accuracy of fit. Nevertheless, one still cannot completely prevent the presence of an air gap between casing 11 and housing 3 within the bore 7, which can lead to an increase of the resistance to heat transfer resistance between the heating cartridge 9 and the wall 3. At correspondingly high heat output powers of the heating cartridge 9, whereby in the housing 1 shown in FIG. 4, preferably eighteen heating cartridges 9 with a respective heat output power of 1 kW can be used, at surface loads of more than 22 W/cm$^2$, local overheating of the heating cartridges may occur. A shortening of the life of the heating cartridges 9 may thereby occur. Due to the use of different materials for the casing 11 and the wall 3, such overheating may especially result in different expansions of the wall 3 and the heating cartridges 9, which can lead to the heating cartridge 9 becoming stuck in bore 7 and unable then to be easily removed from bore 7 within wall 3.

In order to avoid these complications which may possibly occur when using a heating cartridge 9, it is especially proposed with the invention that a heating device be used in which the corresponding casing can be omitted. Such heating devices are shown in FIGS. 5*a*-6*b*.

Figure 5A:
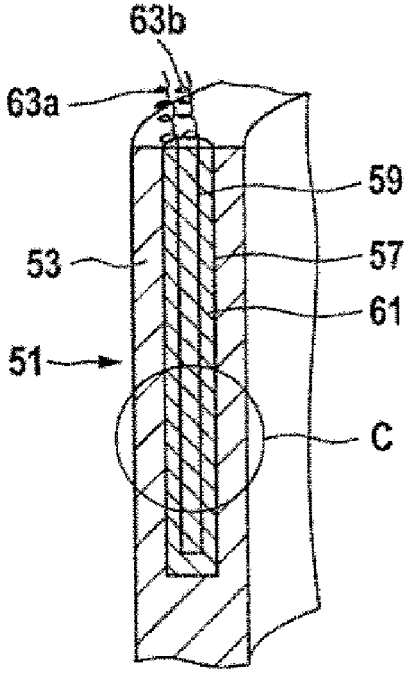
FIG. 5*a* is a schematic partial sectional view of a second embodiment of a housing with another embodiment of a heating device.
Figure 5B:
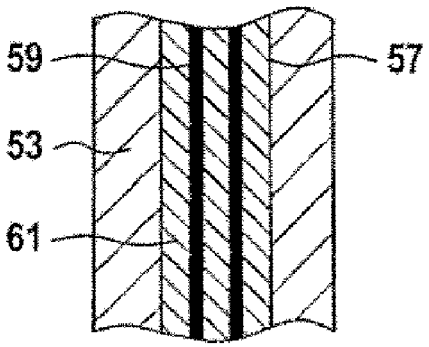
FIG. 5*b* is a magnified view of Section C of FIG. 5*a;*

FIG. 5*a* shows a partial sectional view of a housing 51, while FIG. 5*b* shows a detailed view of section C of FIG. 5*a*, in which the structure of the heating device is shown more accurately. The housing 51 comprises a wall 53 in which a number of bores are made, whereby in FIGS. 5*a* and 5*b* only one bore 57 is shown. Preferably, the wall 53 is made of a metal with high thermal conductivity, such as aluminum, so that the housing 51 is made preferably in the form of an aluminum profile. As can be seen furthermore in FIG. 5*a*, within the (blind) bore 57 a heating wire 59 is inserted directly. The intermediate space formed between the heating wire 59 and the inner wall of bore 57 is filled with a filling material 61, preferably magnesium oxide powder. A compression of the filling material 61 can be achieved especially by appropriate shaking or pressing of the filling material 61 into bore 57.

This embodiment of the heating device offers especially the advantage that the heating devices can be replaced individually in case of malfunction without having to replace the entire housing 51.

Figure 6A:
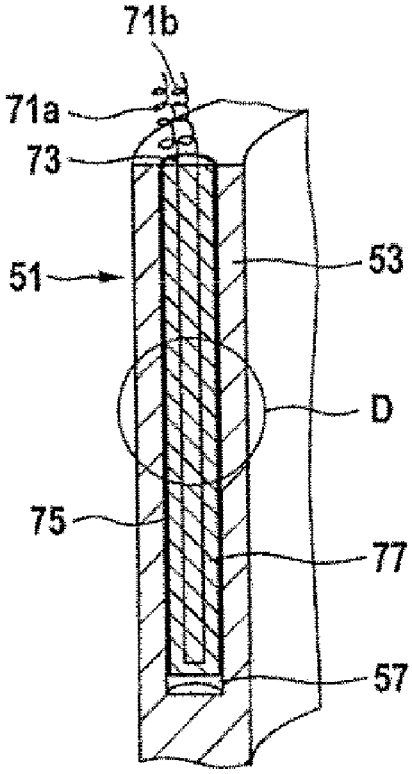
FIG. 6*a* is a partial sectional view of the housing of FIG. 5*a* with another embodiment of a heating device.
Figure 6B:
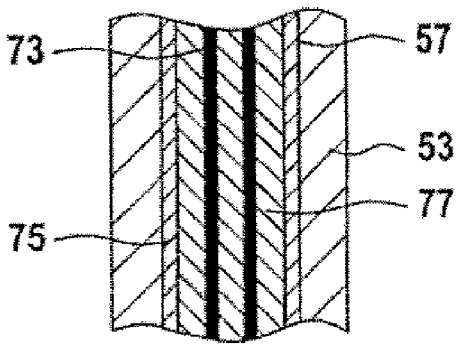
FIG. 6*b* is a magnified view of Section D of FIG. 6*a;*

FIGS. 6*a* and 6*b* show another preferred embodiment of a heating device which is inserted into housing 51. FIG. 6*b* is hereby a detailed view of section D of FIG. 6*a*. In this heating device too, the use of an additional first cladding tube in the form of a casing 11 is omitted or the first cladding tube is formed by the wall 53 of housing 51 itself. Similarly to the heating device represented in FIG. 5*a*, in the heating device shown in FIG. 6*a* a heating wire 73 having lines 71*a*, 71*b* is inserted into bore 57. However, in order to ensure equidistant positioning of the heating wire 73 within bore 57, the heating wire 73 is first inserted into a second cladding tube 75 which is made preferably of magnesium oxide prior to insertion into the bore 57; and the intermediate space formed within the second cladding tube 75 between the inner wall of the second cladding tube 75 and the heating wire 73 is preferably filled with magnesium oxide powder as filling material 77. Then the second cladding tube 75 together with the heating wire 73 is inserted into bore 57. In order to improve the heat transfer from the heating wire 73 into wall 53 in this embodiment, as well as to achieve a compression of the filling material 77, with the invention the following method is proposed, whereby it should be kept in mind that this method can also be applied to the heating device represented in FIGS. 5*a* and 5*b* for compressing the filling material 61.

First of all, the particular heating devices are inserted into the bores 57. By applying an external force onto housing 51, for example, through a tensile or compressive force on housing 51, deformation of wall 53 occurs, which especially results in a reduction of the diameter of the bore 57. This reduction of the diameter of bore 57 results in a higher compression of the filling material 61 or 77. Moreover, the outer periphery of the second cladding tube 75 is thereby adjusted to the inside diameter of bore 57, as a result of which any existing air gap between the second cladding tube 75 and the inner wall of bore 57 is eliminated. Especially, it can be provided that the aluminum profile forming the housing 51 be pulled or pressed by means of a matrix in such a way that the shape of the wall 53 will be altered. Furthermore, it is proposed that the aluminum profile that forms the housing 51 can be processed with the aid of hydraulic presses. Hereby, for example, in the interior chamber of housing 51, a shaped part can be introduced and a pressure be applied on the wall 53 from the outside, which leads to a longitudinal expansion of the housing 51 and to a reduction of the diameter of bore 57.

An essential advantage of the heating devices shown in FIGS. 5*a*, 5*b*, 6*a* and 6*b* consists in the fact that, as a result of the direct filling of the bores 57 of housing 51 with the heating wires 59 and 73, respectively, a higher surface load of the heating devices can be achieved due to the omission of a corresponding first cladding tube in the form of casing 11, as it is provided in the case of heating cartridge 9. Especially good heat transfer is achieved from heating wire 59 or 73 into wall 53, since the heat resistance which could be increased by the air gap caused by the manufacturing tolerances is clearly reduced. In this way the heating output power made available by the heating device and thus its surface temperature can be increased without fear of material failure of the heating wire 59 or 73. Thus, for example, the surface load can be increased up to 35 W/cm$^2$ as long as an appropriate heat removal from wall 53 is ensured, for example in a liquid within the steam generator.

Figure 7:
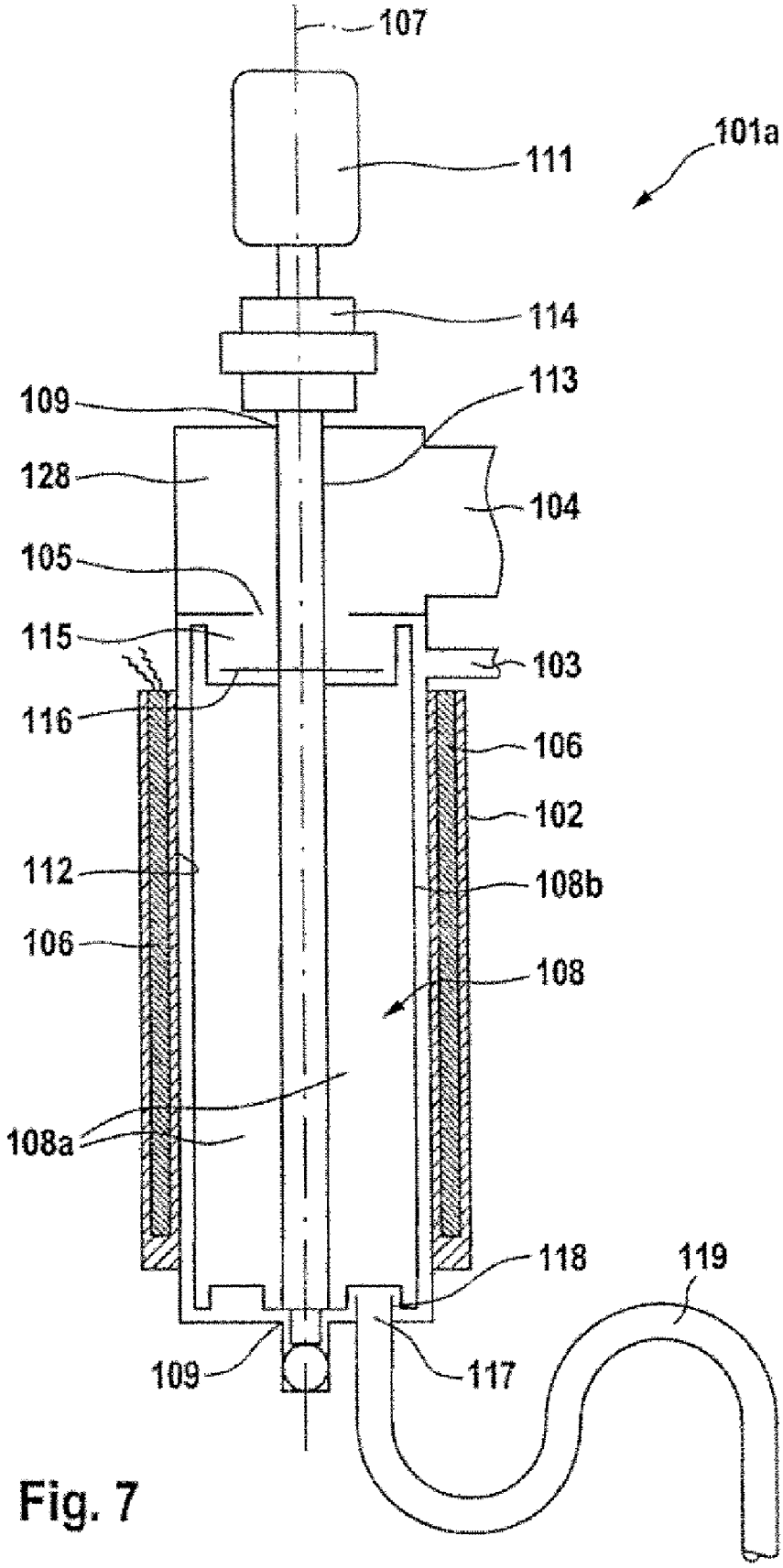
FIG. 7 is a sectional view through a first embodiment of a steam generator according to the invention with resting rotor.

As can be seen in FIG. 7, a device for producing steam according to the invention in the form of a steam generator 101*a* comprises a steam generation container, comprising a heatable housing in the form of a tubular boiler 102 with an inlet in the form of a water inlet 103 and a steam discharge 104 at the upper end of the boiler 102, an orifice 105, which separates the boiler 102 from steam discharge 104 for the separation of the condensate and contaminants, heating elements 106 in the form of heating devices inserted into the bores within the tubular boiler 102 according to the invention, especially in the form of heating cartridges or heating wires inserted directly into the bores, and a rotatable paddle 108 which can be rotated around a rotary axle 107 that coincides with the longitudinal axis of the boiler 102, and which is supported by two bearings 109 and which can be driven with a motor 111 through a coupling 114, which serves to compensate for adjustment errors, and a shaft 113. The paddle 108 has two paddle halves 108*a* each with longitudinal paddle sides 108*b* next to wall surface 112 of boiler 102, a hollow 115 in the area of orifice 105, as well as a baffle plate 116 in order to produce a potential eddy in front of orifice 105. A waste-water discharge 117 is located at the lower end of boiler 102, which has a collar 118 in order to avoid water losses by flow in a boundary layer. The waste-water discharge 117 is closed only with a siphon 119 in order to avoid losses of steam, so that when the paddle 108 stops, the boiler 102 empties automatically.

With the steam generator 101*a* described with reference to FIG. 7, water is introduced through the water inlet 103 into boiler 102 and it is put into rotation by the paddle 108 rotating around the rotary axis 107, in order to be forced against the wall surface 112 of the boiler 102 heated with heating elements 106, which leads to rapid and uniform heating of the water. At the same time, the paddle halves 108*a*, which have fine flexible lips (not shown) on their longitudinal sides 108*b* are kept in the rest position according to FIG. 7 by springs (not shown, and which are pressed by the rotation against the wall surface 112 of the boiler 102. The contact pressure is selected so that the lips scrape the wall surface 112 only lightly. As a result of this, salt deposits, especially lime encrustation, are avoided. Furthermore, the longitudinal sides 108*b* have reinforcements in order to achieve as long lasting a removal action as possible with little wear, or, when the rotor of the removal device has a flexible design, the ends of the used elastic lips are reinforced in order to increase the contact pressure on the wall surface 112 during rotation. In addition, through the orifice 105 both the contaminants in the water as well as the water droplets entrained with the produced steam which were forced due to the rotation of the paddle 108 against the wall surface 112 of the tubular boiler 102 are prevented from being released with the steam from the steam discharge 104.

The geometry of the orifice opening can thereby be designed for increasing the separation rate of steam and liquid, such that a potential eddy is produced, which can be intensified by the preceding baffle plate 116.

Figure 8:
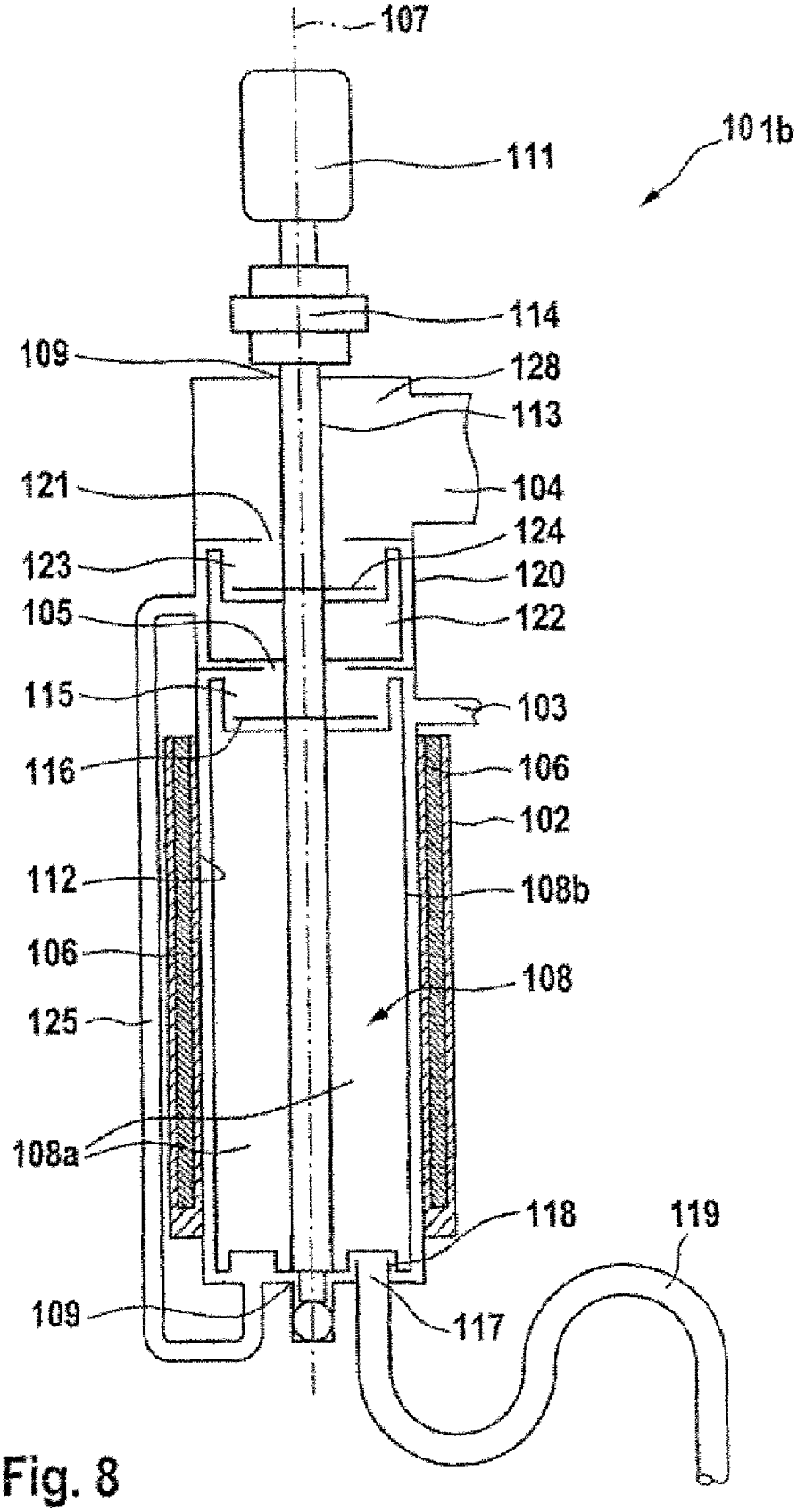
FIG. 8 is a sectional view through a second embodiment of a steam generator according to the invention with resting rotor.

With a small diameter of the boiler 102, in spite of the above countermeasures, water droplets may be entrained at high flow velocities. In the embodiment of the steam generator 101*b* according to the invention, described in FIG. 8, the boiler 102 therefore has a water separation chamber 120 connected after it, which again separates the entrained water and is delimited by a second orifice 121. A second paddle 122 rotates in this water separation chamber 120, which is driven by the same shaft 113 as paddle 108 and which also has a hollow 123 and a baffle plate 124 in order to produce a potential eddy. The water droplets that were produced by the rotation caused by the paddle 122 are returned through a water return 125 in the form of a tube line or hose line into the boiler 102 again. All other components of the steam generator 101*b* according to FIG. 8 correspond to those of the steam generator 101*a* according to FIG. 7.

Figure 9:
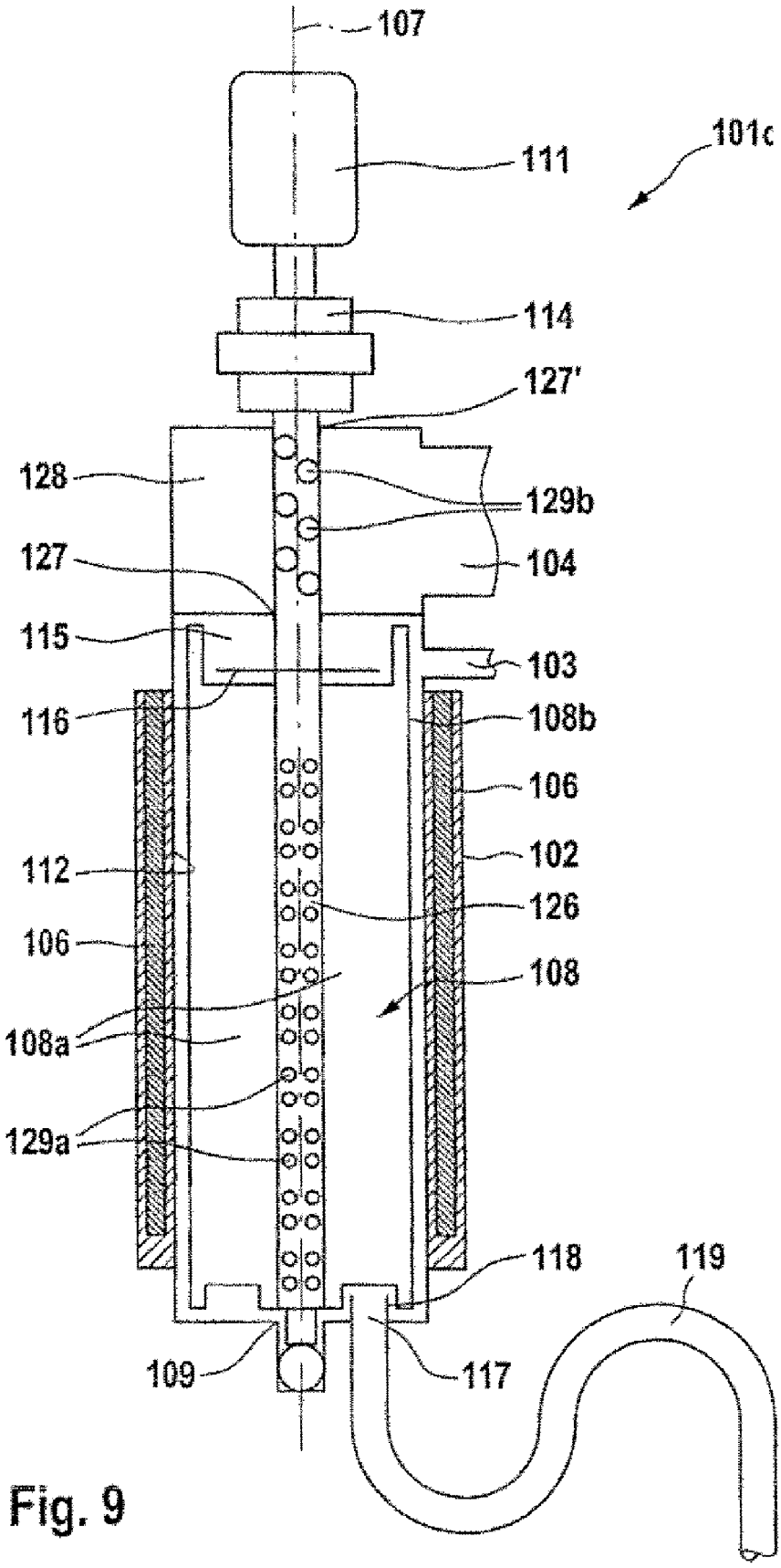
FIG. 9 is a sectional view through a third embodiment of a steam generator according to the invention with resting rotor.

In FIG. 9 another steam generator 101*c* according to the invention is depicted, in which additional measures are implemented in order to reduce the entrainment of water in the case of a small boiler diameter, whereby identical components are given identical reference numbers. The paddle 108 is driven here by a hollow shaft 126, which at the same time serves to guide the produced steam out of the boiler 102. In order to move the steam into the inside of the hollow shaft 126, this must be provided with radial bores 129*a* or slits along the entire wetted length in the evaporator chamber, that is, in the boiler 102; the diameter or density of these bores 129*a* or slits is varied in the axial direction so that the pressure drop caused by the flow is compensated in the hollow shaft 126 and thus the flow component in the direction of the rotary axle 107 in the boiler 102 outside the hollow shaft 126 and at the same time the entrainment of water is minimized. Outside the boiler 102 the steam can be coupled out again, for example through additional radial bores 129*b* in the hollow shaft 126 or through an axial opening (not shown) at the end of shaft 126.

The shaft 126 is supported at the lower end of the boiler 102, whereby it can be narrowed to a correspondingly thinner solid shaft. At the upper end of the boiler 102 the hollow shaft 126 is guided through a sealing or steam-tight bearing 127 from the boiler 102 into a steam outlet chamber 128 lying above it. In this steam outlet chamber 128 above the boiler 102, the hollow shaft 126 has bores 129*b* in order to allow the produced steam to exit again and to be introduced to the steam discharge 104. At the other end of the steam discharge chamber 128 the hollow shaft 126 is guided out again with a seal or steam-tight bearing 127', whereby the hollow shaft 126 can go into a thinner solid shaft in or above the steam discharge chamber 128. Above the steam discharge chamber 128, the hollow shaft 126 is coupled to the motor 111 through a coupling 114 to equalize alignment errors between motor axle and the hollow shaft 126.

In addition, the state of filling of the steam generator 101*a*, 101*b* or 101*c* can be obtained by measurement of a centrifugal-force-induced pressure at the inner and/or outer wall of the boiler 102.

Hereby it is especially preferred that a water pressure sensor is arranged near the inner and/or outer wall of the boiler 102 and that the heat output power of the heating elements 106 is adjusted with the aid of the water pressure determined by the water pressure sensor using a control and/or regulation unit which is not shown, which is connected to the water pressure sensor as well as to the heating elements 106. In this way it can be ensured that a constant water pressure is produced within the rotary steam generator 101*a*, 101*b* or 101*c* along the inner wall of the boiler 102, which results in the fact that deposits on the inner wall of the boiler 102 are avoided, or at least reduced. By appropriate alteration of the power of the heating elements 106, thus a corresponding setting of a constant water pressure is achieved.

Removal of the lime from a steam generator 101*a*, 101*b* or 101*c* according to the invention, is achieved by the flexible lips on the longitudinal paddle sides 108*b* of the paddle halves 108*a*, which remove the deposits continuously from the outer wall during operation. The lips themselves do not wear essentially, since they themselves acquire lime deposits in the region where they are immersed in the water film and thus substantially the shaving occurs with lime on lime. However, no excessive amount of lime can collect on paddle 108 because this is driven toward the outside by the centrifugal force and finally it will be shaved off there. The lime meal thus produced must only be removed regularly from the boiler by rinsing or by changing the water. The use of flexible lips as a removal device or the flexible design of the rotor itself involves the advantage that any existing deposits cannot adhere to the rotor when the wall surface 112 is in the resting position, since the centrifugal force during rotation establishes the contact of the rotor or of the removal device with the wall surface 112. In order to make automatic emptying possible, the lower end of the boiler 102 can be provided with another orifice or a closure mechanism (not shown). Hereby the orifice 105 can be combined with such an orifice upstream from the steam discharge 104.

Figure 10A:
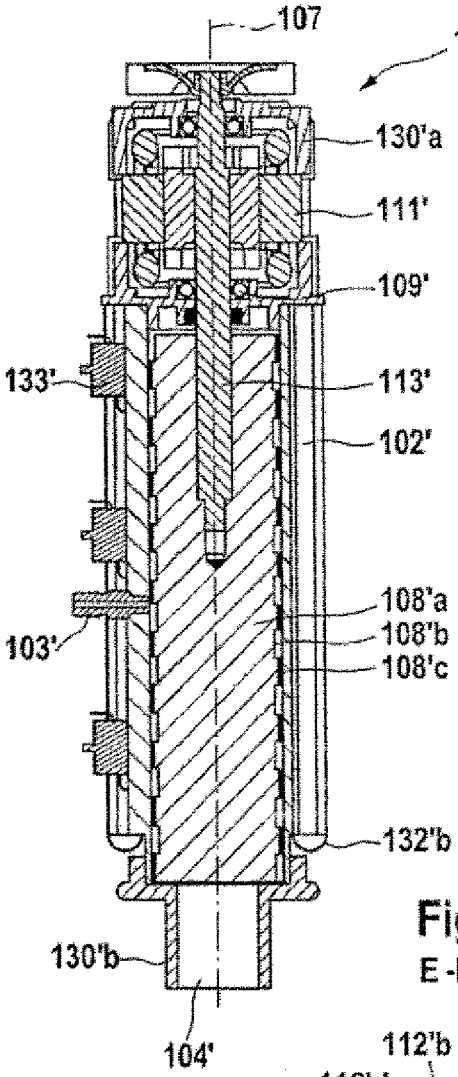
FIG. 10*a* is a first partial sectional view through a fourth embodiment of a steam generator according to the invention with resting rotor.
Figure 10B:
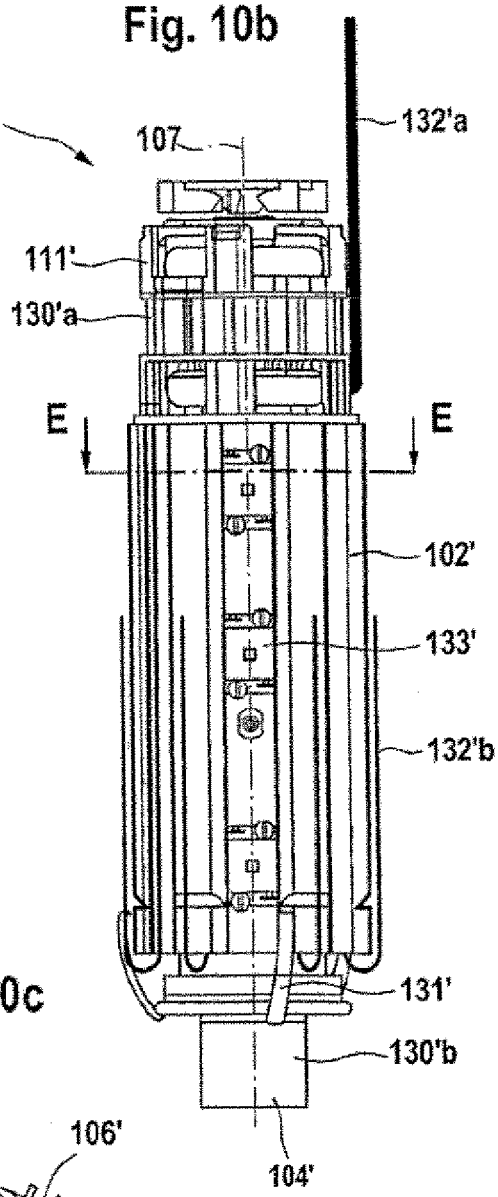
FIG. 10*b* is a side view of the steam generator shown in FIG. 10*a*.
Figure 10C:
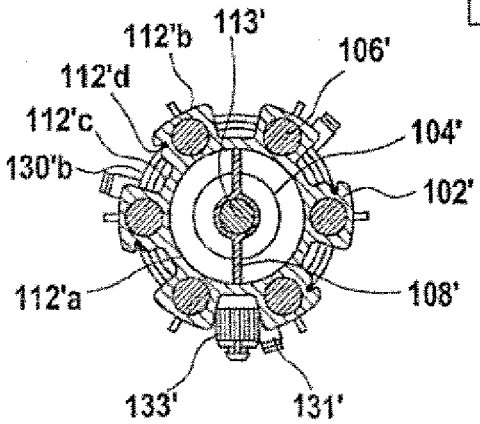
FIG. 10*c* is a sectional view of the steam generator shown in FIG. 10*b* along line E.

Another device according to the invention is shown in FIGS. 10*a* to 10*c* in the form of a steam generator 101'*d*. However, the steam generator 101'*d* differs considerably from the alternatives described above. First of all it should be pointed out that a boiler 102' of the steam generator 101'*d*, which is designed essentially in a tubular form, and is aligned with a its longitudinal axis parallel to the direction of the gravitational force, has a water inlet 103' in its middle region between its two ends. It is also of special importance that in this embodiment the steam discharge and the water discharge are formed as one unit namely in the form of a steam-and-water discharge 104' at the lower end of the boiler 102', namely in a lower cover 103'*b*. A motor 111' is arranged in an upper cover 130'*a*, the shaft 113' of which extends all the way into the boiler 102' and is there screwed together with the shaft of a paddle 108'. In turn paddle 108' has two paddle halves 108'*a*, each with longitudinal paddle sides 108'*b* which have paddle lips 108'*c* with which the paddle 108' can contact the inner wall 112'*a* of the boiler 102', especially in order to scrape the lime deposits and similar off from the wall surface 112'*a* during operation, that is, when the paddle 108' is rotating. Furthermore, the shaft 113' is supported only by a bearing 109' at the upper end of the boiler 102' and extends, together with the paddle shaft less than half way into the boiler 102' along its longitudinal axis, coinciding with the rotary axis 107' of paddle 108', as can be seen especially in FIG. 10*a*.

The upper cover 130'*a* is screwed onto the boiler 102', whereby the screw channels 112'*d* are provided in the boiler 102', as can be seen especially in FIG. 10*c*. The lower cover 130'*b* can be simply clamped onto the boiler 102' with the aid of springs 131', as shown especially in FIG. 10*b*. This simple construction with covers 130'*a* and 130'*b* which can be removed from the boiler 102' leads to an especially compact construction.

Moreover, it should be stated that by combining steam discharge and the water discharge in the lower cover 130'*b*, not only does not the shaft 113' not have to be guided from the upper cover 130' to the lower cover 130'*b*, but also no bearing is necessary for the paddle 108' in the area of the boiler 102', in which water, steam and/or lime can be present, so that damage of it is avoided, which increases the durability of the steam generator 101'*d* overall.

The separation of steam and water downstream of the lower cover 130'*b* is not shown in FIGS. 10*a* and 10*b*, but can be carried out with a simple siphon. Above such a siphon, a branch can be introduced through which the steam can be guided through a riser into a cooking compartment of a cooking appliance not shown. The entrainment of water in the steam can be adjusted by the dimensioning of the riser and additionally possibly through its shape.

The water boiler 102' as well as its covers 130'*a* and 130'*b* can be made as cast aluminum parts and, after assembly, they may be joined in a low-vibration manner, using a rubber-supported screw connector, which is not shown, near the center of gravity of the steam generator 101'*b*, to a cooking appliance structure.

As FIG. 10*c* shows, in the water boiler 102', six heating elements 106' are arranged equidistantly to one another, namely each in a hollow within the water boiler 102'. In addition, between heating elements 106, which can be designed as described in the previous embodiments, recesses 112'*c* in the outer wall surface 112'*b* are arranged, which lead to a reduction of material as well as of the mass of the water boiler 102'. This savings in material permits temperature-dependent expansions and contractions of the water boiler 102' to such an extent that flaking off of the lime layers from the inner wall surface 112'*a* of the water boiler 102' can occur. Namely, without these recesses, buildup of a lime layer may occur which is so thick that it could lead to an elevated temperature in the heating elements 106' and thus to increased wear and finally failure of the steam generator 101'*d*. Moreover, in case of a lime layer, contact between the paddle 108' and the lime layer could occur, such that the paddle 108' might stop altogether, that is, a blockage of the rotation of it might occur.

The individual heating elements 106' are joined through cables 132'*a* and 132'*b* with a control device, which is not shown, of a cooking appliance which is not shown, similarly to motor 111'. Moreover, three thermal switches 133' are provided and the heating elements 106' can be controlled dependent on these using the control device. A pressure sensor, which is not shown, can also be provided, with the aid of which the pressure can be determined within the water boiler 102', for example at different heights, in order to be able to use these values too in the control of the heating elements 106' as well as also of the motor 111'.

Instead of six heating elements, one could also use, for example, three heating elements. These would then be arranged preferably at an angle of 120° to one another within the water boiler. At a length of, for example, 235 mm per heating element, an actual heatable length of the water boiler of ca. 200 mm and a diameter of 20 mm per heating element, one arrives at a surface load of approximately 8 W/cm$^2$ on the heating element surface, when each heating element has a power of 6 kW.

The characteristics of the invention disclosed in the above specification, in the claims as well as in the drawings, can be essential both individually as well as in any arbitrary combination for the realization of the invention in its various embodiments.

The invention claimed is:

1. Device for producing steam, comprising at least one container that has an interior chamber that can be filled, at least partially, through an inlet with a liquid, which is heatable, from which steam can be guided to a steam discharge and that can be emptied at least partially through a discharge, the container comprises at least one heatable housing with at least one wall which delimits an interior chamber surrounded by the housing at least in areas, for holding a liquid to be evaporated, and the wall comprises at least one hollow for holding at least one heating device, the device being designed for producing steam for a cooking appliance, and each heating device comprising at least one heating wire through which electrical current can flow, whereby the heating wire is surrounded at least in areas by at least one of a first cladding tube and a second cladding tube, and at least one geometrical dimension of the first cladding tube can be altered by the application of one of a compressive and a tensile force, in order to at least one of:

avoid at least one air gap between the first cladding tube and at least one of the housing and the second cladding tube; and compress a filling material into at least one of an intermediate space between the heating wire and the first cladding tube, an intermediate space between the heating wire and the second cladding tube, and an intermediate space between the second cladding tube and the first cladding tube.

2. Device for producing steam according to claim 1, wherein the first cladding tube forms a casing for at least one heating cartridge adapted to be inserted, at least in areas, into one hollow, the outer geometry of the casing corresponding essentially to the inner geometry of the hollow.

3. Device for producing steam according to claim 1, wherein the first cladding tube comprises a hollow surrounded by the wall.

4. Device for producing steam according to claim 1, the heating wire is disposed in the first cladding tube together with the second cladding tube.

5. Device for producing steam according to claim 1, wherein at least one of the filling material and the second cladding tube comprises at least one of an electrically insulating material and a heat conducting material.

6. Device for producing steam according to claim 1, wherein the device comprises several heating devices distributed at least one of equidistantly and concentrically around the interior chamber.

7. Device for producing steam according to claim 1, wherein each hollow comprises at least one bore which at least partially penetrates the wall.

8. Device for producing steam according to claim 7, wherein the wall comprises an inner wall surface that faces the interior chamber of the housing, the inner wall surface free from penetration by the bores.

9. Device for producing steam according to claim 8, wherein the wall comprises an outer wall surface that faces away from the interior chamber of the housing, the outer wall surface comprising at least one of:

at least one first recess disposed between at least two neighboring heating devices, at least one second recess, and at least one third recess in the area of at least one heating device.

10. Device for producing steam according to claim 9, wherein each second recess is disposed in the area of a heating device and opens into a corresponding hollow and is adapted to be closed for fixing the heating device in the hollow.

11. Device for producing steam according to claim 9, wherein each third recess comprises a screw channel in the area of a heating device and opens into a first recess but does not open into any hollow.

12. Device for producing steam according to claim 1, wherein the interior chamber that is surrounded by the housing comprises an inner wall surface that is cylindrical, at least in areas, and an outer wall surface that is cylindrical, at least in areas.

13. Device for producing steam according to claim 1, further comprising at least one of:

a temperature sensor and/or thermal switch in thermal contact with the wall, and a control and/or regulation device in working connection with each heating device for adjusting each heating device as a function of the output data of the temperature sensor and/or of the thermal switch.

14. Device for producing steam according to claim 8, further comprising at least one rotor supported in the interior chamber of the housing for setting the liquid into rotation at least during heating.

15. Device for producing steam according to claim 14, wherein the rotor comprises at least one paddle driven through a shaft connected to a motor.

16. Device for producing steam according to claim 15, wherein the interior chamber comprises two open ends and a longitudinal axis, the interior chamber having a rotational symmetry with respect to the longitudinal axis.

17. Device for producing steam according to claim 15, wherein the paddle comprises at least one longitudinal side comprising at least one of paddle lips and paddle teeth, the longitudinal side contacting the inner wall surface of the container at least some of the time.

18. Device for producing steam according to claim 15, further comprising a first cover and a second cover, the first cover separably closing one of the two open ends of the interior chamber, and the second cover separably closing the other of the two open ends of the interior chamber.

19. Device for producing steam according to claim 18, wherein the first cover accommodates at least one of the motor and the steam discharge.

20. Device for producing steam according to claim 18, wherein the second cover accommodates at least one of the discharge and the steam discharge.

21. Device for producing steam according to claim 18, further comprising at least one spring element for locking at least one of the first cover and the second cover to the container.

22. Device for producing steam according claim 18, wherein the shaft is supported in the first cover and extends in the direction of the second cover, whereby the shaft extends at least over half the distance between the first and second cover.

23. Device for producing steam according to claim 15, wherein the control and/or regulation device is in working connection with at least one of the motor, a first closing member in the inlet, a second closing member in the discharge, a third closing member in the steam discharge, and at least one pressure sensor.

24. Cooking appliance with a control and/or regulation unit and at least one device for producing steam according to claim 13, wherein the control and/or regulation unit controls the device for producing steam.

25. Cooking appliance according to claim 24, wherein the device for producing steam is supported in the area of its center of gravity in the cooking appliance with the aid of a rubber-supported screwed connection with low vibration.

* * * * *